US005143485A

United States Patent [19]

Faas et al.

[11] Patent Number: 5,143,485

[45] Date of Patent: Sep. 1, 1992

[54] TRANSPORT AIR CONTROL

[75] Inventors: Jürg Faas, Dinhard; Christoph Stäheli, Frauenfeld; Robert Demuth, Nürensdorf; Robert Moser, Winterthur, all of Switzerland

[73] Assignee: Maschinenfabrik Rieter AG, Winterthur, Switzerland

[21] Appl. No.: 536,210

[22] Filed: Jun. 11, 1990

[30] Foreign Application Priority Data

Jun. 16, 1989 [DE] Fed. Rep. of Germany ..... 3919744
Dec. 7, 1989 [DE] Fed. Rep. of Germany ..... 3940524

[51] Int. Cl.[5] ..... B65G 53/04
[52] U.S. Cl. ..... 406/14; 406/197
[58] Field of Search ..... 406/10, 14, 197

[56] References Cited

U.S. PATENT DOCUMENTS 4,171,262 10/1979 Lattmann et al. .
4,321,732 3/1982 Erben .
4,696,608 9/1987 Staheli .
4,701,981 10/1987 Leifeld .
4,715,748 12/1987 Krambrock ..... 406/14 X
4,940,367 7/1990 Staheli et al. .
5,048,761 9/1991 Kim ..... 406/197 X

FOREIGN PATENT DOCUMENTS 0000033 12/1978 European Pat. Off. .
0175056 3/1986 European Pat. Off. .
0181452 5/1986 European Pat. Off. .
0303023 2/1989 European Pat. Off. .
1148938 5/1963 Fed. Rep. of Germany .
2435677 3/1975 Fed. Rep. of Germany .
2461093 7/1976 Fed. Rep. of Germany .
2629901 2/1977 Fed. Rep. of Germany .
3217667 12/1982 Fed. Rep. of Germany .
3134180 3/1983 Fed. Rep. of Germany .
2433063 3/1980 France .
2573780 5/1986 France .
115526 9/1980 Japan ..... 406/14
13306 1/1989 Japan ..... 406/14

*Primary Examiner*—Russell D. Stormer
*Assistant Examiner*—Gary C. Hoge
*Attorney, Agent, or Firm*—Sandler, Greenblum & Bernstein

[57] ABSTRACT

A method of operating a pneumatic transport system in a process line of a spinning mill, wherein fiber flocks are transported through ducts by means fo airflows generated by fans and these airflows can be influenced by units such as fans, adjustable flats, leakage air openings and induction boxes. In critical regions the respectively prevailing static pressure is measured by means of pressure sensors and, in so far as this pressure lies outside of a predetermined desired range a correction is first made at one of the units which contributes to determining this pressure in the sense of changing the pressure into the desired range or in the direction towards the desired range. The effect of this change in other critical regions effected thereby is then determined with reference to the pressure measured there and a change is subsequently effected of a further unit responsible for the pressure in these regions. The above process steps are repeated in the sense of an iterative adaptation to the desired ranges, i.e. until the measured pressures lie in the respectively provided desired ranges.

20 Claims, 3 Drawing Sheets

TRANSPORT AIR CONTROL

BACKGROUND OF THE INVENTION

1. Field of the Invention

The present invention relates to a method of operating a pneumatic transport system in a process line of a spinning mill, for example a cleaning line or blow room line which extends from a bale opening machine via cleaning machines and/or mixing machines and/or metering machines to a carding system, optionally with autonomously operating regions, wherein fiber flocks are transported through ducts by means of airflows generated by fans and these airflows can be influenced by units such as fans, adjustable flaps, leakage air openings and induction boxes. The present invention also relates to an apparatus for carrying out the method.

2. Description of Related Art

The operation of a pneumatic transport system in a process line of a spinning mill has a decisive effect on the efficiency of the treatments carried out by the process line. The incorrect adjustment of the various fans, adjustable flaps and leakage air supply orifices not only leads to an undesired increase in the energy costs but also to performance penalties in the various treatment units. For example, it is important in a coarse cleaning machine to provide the correct static pressure conditions for the operation of the coarse cleaning unit. If the pressure is too high, then this leads to the generation of dust and too much waste material, i.e., exploitable product material is lost with the waste. If, on the other hand, the pressure is too low, then the waste material with dust can be sucked in again so that the cleaning action leaves something to be desired.

In spinning mills the operators are afraid, above all, of blockages which can arise through accumulations of fiber flocks. In order to counteract blockages, the basic settings of the suction fans which are preferably used are frequently set to a maximum in practical operation, although this is not correct for the technology of the treatments which are to be carried out. As a result, unnecessarily high energy costs are caused and the performance or efficiency of the treatment unit is reduced. The problem is particularly acute in cases where several units are provided which influence the pressure in critical regions, and indeed because the adjustment of the one unit frequently causes an effect at other units which is not properly taken into account by the operator.

The object of the present invention is to so develop a method or apparatus of the initially named kind where one achieves a correct adjustment of the adjustable units in a relatively simple way using relatively simple means, i.e., achieves an adjustment which, on the one hand, reduces the energy costs but, on the other hand, ensures that the treatments which are to be carried out can be carried out with a high degree of efficiency. At the same time the method or apparatus of the present invention should make it possible to monitor the pressure conditions and also to prevent the occurrence of blockages.

In order to satisfy this object method-wise one proceeds in accordance with the invention in such a way that a) in critical regions the respectively prevailing static pressure is measured by means of pressure sensors and, in so far as this pressure lies outside of a predetermined desired range, a correction is first made at one of the units which contributes to determining this pressure in the sense of changing the pressure into the desired range or in the direction towards the desired range, b) in that the effect of this change in other critical regions affected thereby is determined with respect to the pressure measured there and a change is subsequently effected of a further unit responsible for the pressure in these regions, c) in that the steps a) and b) are repeated if required, eventually while changing the settings of other units, in the sense of an iterative adaptation to the desired ranges, i.e., until the measured pressures lie in the respectively provided desired ranges.

The regulation steps should preferably be so effected that any short term fluctuations which occur are ignored.

Through the use of an iterative method of this kind, one succeeds in bringing the pressure values in the critical regions into the respectively predetermined desired ranges, although the adjustments of the individual units lead to pressure changes in a plurality of critical regions. The adjustment is also made possible by means of relatively simple devices such as pressure sensors and a computer programmed in accordance with the regulation process, with the computer simply calculating the desired values for the adjustment of the individual variable units and with the actual adjustment of these units being effected by the respective machine control which is in any case present. A precondition for the use of this method is solely that for the respectively prevailing rate of production (kg/h) one specifies corresponding desired pressure values for the individual critical regions. This is however normal since in the design of the individual treatment units the designer must always think about the desired or permissible pressure values.

A particularly favorable feature of the method of the invention is the fact that after achieving pressures in the critical regions which lie within the desired ranges the regulation process can be temporarily terminated. The regulation process is thus suitable as one task for a computer which controls the entire system or part of the system. As this one task only takes place when starting up the system, or when a change in production occurs, it is a task which can largely be carried out by the computers which are already present in such systems. Thus, no substantial additional costs arise on realizing the invention.

Since pressure sensors have to be arranged in the critical regions in order to carry out the "optimization phase" when starting up the system, and on a change of the relevant production factors, the same sensors can be used during permanent operation of the system to monitor the operation without significant additional costs. By way of example, the pressure values prevailing in the critical regions can be controlled at intervals of time and, if required, newly set. Corrections are only necessary in exceptional cases, for example when a change in pressure points to the development of a blockage. If one uses the pressure sensors for this purpose then the checks can take place at very short time intervals. Otherwise, it is sufficient to effect the checks at intervals in the range from a day up to several months, preferably once weekly.

After a stop in production or a change of material the adjustment of the pressures should be checked and, if necessary, corrected after restarting production.

As previously indicated the desired ranges should be selected or newly set in accordance with the envisaged production. The method of the invention is usable in all autonomously functioning regions in which several units influence the pressure at the respective critical regions.

In autonomously functioning regions in which only one unit is responsible for the pressure prevailing in a critical region, this unit is separately adjusted, controlled or regulated. In carrying out the method of the invention, it is of advantage for each critical region to effect the first change at the unit which most strongly affects the pressure in this region. One can namely assume, in the sense of the invention, that a change at this unit will have less effect on the pressure values in other critical regions which then ensures that the iterative process converges rapidly and reliably.

Furthermore, the sizes of the changes which are successively effected should be made increasingly smaller in order to achieve a convergent iterative adjustment of the pressures into the desired ranges.

The method of the invention can, in particular, be used in a process line which comprises a bale opening machine which feeds fiber flocks into a duct, a suction ventilator provided in the duct, optionally a metal separating unit and/or dust extracting unit built into the duct, a coarse cleaning unit, a second suction fan and also optionally a fire separating unit with a spark sensor, with processed waste material eventually being fed into the duct between the bale opening machine and the first-named suction fan. The method is then characterized in accordance with the invention in that the pressure of the duct is measured in a first critical region at the outlet of the bale opening machine before the first-named suction fan and before the feed position for any waste which is eventually fed into the duct and also in a second critical region before the second suction fan; in that the pressure is adjusted in the first critical region, principally by changing the displacement rate of the first suction fan; in that the pressure in the second critical region is adjusted by changing the degree of opening of a leakage air orifice which opens into the duct and/or the discharge rate of the second suction fan; and in that the two last named steps are carried out until the pressures prevailing in the first and second critical regions lie within the respective desired ranges.

The fans which are built into the treatment units and which are of importance for the treatment which is carried out, but have, however, little to do with the transport function of the flocks through the process line, are, in accordance with the invention, preferably fixedly set. In a specific embodiment of the invention, the pneumatic transport system is for a process line of a spinning mill in which a bale opening machine feeds fiber flocks into a tubular duct which, when considered in the direction of flow, leads via a first suction fan and, optionally, via a metal separating unit and/or a duct separating unit, via a coarse cleaning unit and via a second suction fan to a flock mixer, with the flocks being separated from the transport air prior to or in the mixer, and wherein a fire separating unit with a spark sensor is optionally provided between the second suction fan and the coarse cleaning unit, wherein a leakage air orifice opens into the duct after the second suction fan and wherein processed waste material can be eventually fed into the duct between the bale opening machine and the first suction fan. Further, pressure sensors are provided in critical regions of the transport system, for example at the point at which flocks are fed from the bale opening machine into the duct and at a position after the coarse cleaning unit and before the second suction fan. A regulating means is provided which can be programmed with respective desired value ranges for each critical region at each envisaged rate of production. An iterative adjustment of the units which influence the respective pressures at the critical regions can be carried out by the regulation system until the pressures lie within the respective desired ranges.

The method of the invention includes the steps of:

(a) measuring, in each of a plurality of critical regions, the respectively prevailing static pressure by means of pressure sensors;

(b) determining whether at least one of the respectively prevailing static pressures is outside of a predetermined desired range;

(c) adjusting at least one of the units in a manner to affect the at least one of the respectively prevailing static pressures to change same in a direction toward or into the desired range, if the at least one of the respectively prevailing static pressures is outside of the predetermined desired range;

(d) determining the magnitude of a change in a prevailing static pressure in at least one further critical region affected by the step of adjusting;

(e) adjusting a further one of the units in a manner to affect the prevailing static pressure in the at least one further critical region to change same toward or into a predetermined desired range for the at least one further critical region, if the prevailing static pressure of the at least one further critical region is outside of the predetermined desired range for the at least one further critical region; and (f) repeating steps (a) through (e), as necessary, until measured pressures line in the desired ranges. In a further aspect of the invention, short term pressure fluctuations which occur are ignored during the steps of determining.

The method further can include the step of terminating the method after the critical regions lie within respective desired ranges.

Still further, the invention includes the steps of measuring the pressures prevailing in the critical regions at intervals of time and, if any of the prevailing pressures are outside respective desired ranges, performing again the steps of adjusting until prevailing pressures at the critical regions lie within respective desired ranges. The steps of measuring are performed in time intervals in the region from once per day to once per several months, or in the region of once per week.

Further, steps (a) through (f) are performed after a stop in production of the spinning mill or a change in material composition of material transported through the pneumatic transport system.

Still further according to the invention is the step of determining an intended rate of production and setting the desired ranges as a function of the intended rate of production and, further the step of changing a production rate and adjusting prevailing pressures in the critical regions in accordance with the steps of adjusting.

In a further aspect of the invention, the pneumatic transport system further includes autonomously functioning regions of the pneumatic transport system, whereby a plurality of units determine the pressure in the respective critical regions, wherein the method further includes performing steps (a) through (f) in the autonomously function regions.

Further, the system can further include autonomously functioning regions of the pneumatic transport system in which only one unit, respectively, is responsible for the pressure prevailing at a respective critical region, wherein the steps are separately performed for the one unit.

In a still further aspect of the invention, for each of the critical regions, a step of adjusting is first performed for a unit which affects the prevailing pressure to the greatest degree.

The method of the invention can further include the steps of adjusting being performed in a sequence corresponding to an order of critical regions with regard to the direction of flow, beginning at a critical region at which a step of adjusting is first required, as defined in steps (c) and (e).

Still further according to another aspect of the invention, the steps of adjusting include adjusting the units in successively smaller amounts to achieve a converging iterative adjustment of the prevailing pressures into the respective desired ranges.

According to an additional feature of the invention, the bale opening machine feeds fiber flocks into a duct of the pneumatic transport system, the fans include a first suction fan provided in the duct, a coarse cleaning unit, a second suction fan, a means for feeding processed waste into the duct between the bale opening machine and the first suction fan, and wherein:

(i) the step of measuring is performed (1) in a first critical region at an outlet of the bale opening machine upstream of the first suction fan and upstream of the means for feeding processed waste and (2) in a second critical region upstream of the second suction fan;

(ii) the step of adjusting at least one of the units comprises adjusting a displacement rate of the first suction fan for adjusting the prevailing pressure in the first critical region;

(iii) the step of adjusting a further one of the units comprises performing at least one step selected from the group consisting of (1) changing a degree of opening of a leakage air orifice which opens into a duct, and (2) adjusting a displacement rate of the second suction fan for adjusting the prevailing pressure in the second critical region;

the steps (ii) and (iii) are performed repeatedly until measured pressures lie within the desired ranges.

In a still further aspect of the invention, the method further includes the steps of continuously measuring the prevailing pressures; performing at least one step selected from the group consisting of (1) providing a warning signal and (2) discontinuing fiber flock transport upon measurement of a prevailing pressure at an impermissible deviation from a selected pressure.

Further, in an additional aspect of the invention, the method includes the steps of measuring the prevailing pressures at regularly repeating intervals; performing at least one step selected from the group consisting of (1) providing a warning signal and (2) discontinuing fiber flock transport upon measurement of a prevailing pressure at an impermissible deviation from a selected pressure.

In a still further aspect of the invention, at least one of the fans is built into treatment devices of the fiber flocks and does not significantly affect the prevailing pressures.

Still further, in an additional aspect of the invention, the method includes the steps of measuring a pressure differential across at least one of the fans and determining the value of a variable parameter of the at least one of the fans; determining a prevailing volume flow through the at least one of the fans with reference to a performance characteristic of the at least one of the fans, relating pressure differential to volume flow for various settings of the variable parameter; and iteratively varying the variable parameter of the at least one of the fans until a pressure difference is measured which corresponds at a prevailing setting of the variable parameter of the at least one of the fans to a desired volume flow through the at least one of the fans.

BRIEF DESCRIPTION OF THE DRAWINGS

The invention will now be described in more detail in the following with reference to the drawing in which are shown.

DETAILED DESCRIPTION OF THE INVENTION

Figure 1:
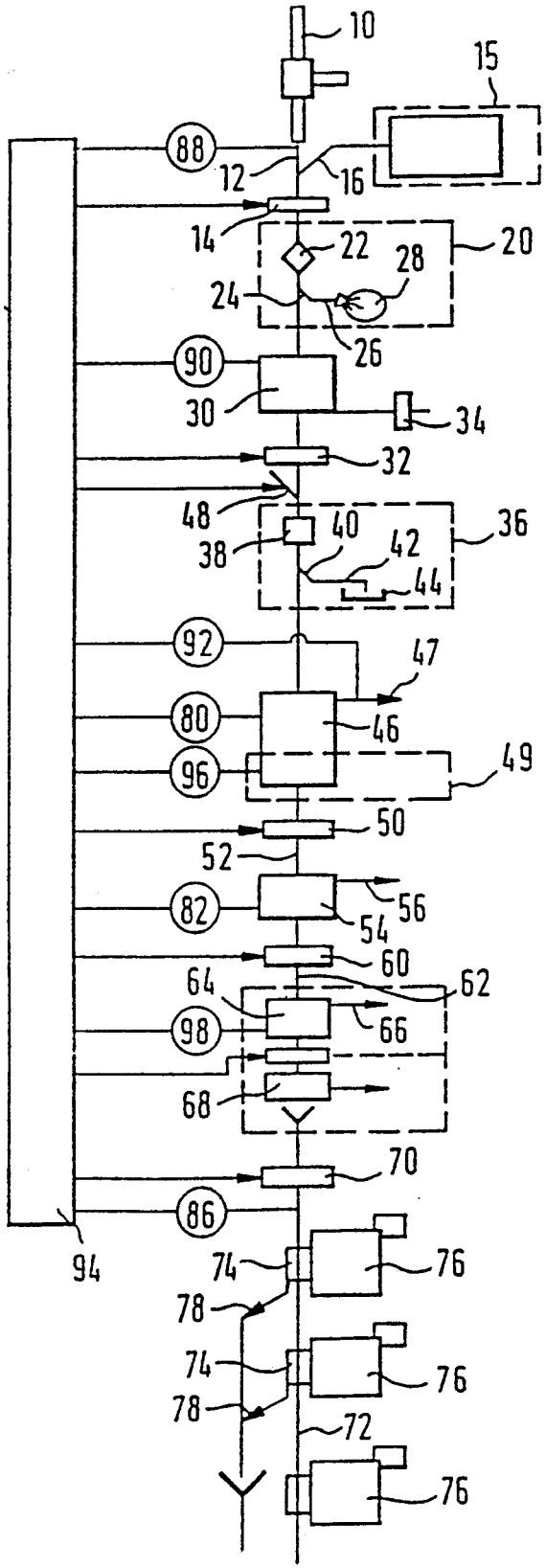
FIG. 1 illustrates a schematic representation of a process line with an air stream regulating system in accordance with the invention.

The process line comprises, in the flow direction, a bale opening machine 10 which removes flocks from non-illustrated bales of flocks and feeds them into a pneumatic conveying duct 12. As usual in pneumatic transport systems in spinning mills the system operates with suction fans so that all leakages take place into the transport ducts, and the environment is not contaminated with fiber fly, which would have to be feared if the pneumatic system were operated with overpressure. The take-up into the pneumatic conveying duct 12 of the flocks separated out by the bale opening machine takes place by means of a first suction fan 14 which is arranged in the pneumatic conveying duct 12.

A branch line 16 opens into the pneumatic conveying duct 12 between the bale opening machine 10 and the first suction fan 14 and offers the possibility of feeding prepared waste into the conveying duct. For this purpose the opening of the branch line 16 is provided with a slide gate 18 which can be selectively opened. The unit 15 and also the other optional units contained in the drawing are framed with a broken line.

As an option, a metal separating unit 20 comprising a metal detector 22 and also a rapid discharge flap 24 can be arranged downstream of the first suction fan. If the metal detector determines the presence of a metal part, for example of a nail, then the flap is controlled to open and the metal part is directed out of the conveying duct 12 into a branch line 26 to a collection sack 28.

After this metal separating unit (if present), the transport duct 12 leads into a coarse cleaning unit 30, which can for example be a mono-cylinder cleaner model B4/1 of Maschinenfabrik Rieter AG. In this cleaner there is always a reduced pressure and the separated flocks are guided in an approximately spiral track with three turns around a rotating roller having radial pins before the flocks leave the coarse cleaning machine in a tangential path and are transported out of the region of the coarse cleaning machine in a further section of the pneumatic conveyor duct 12. The flocks are first guided opposite to the direction of movement of the pin roller, so that they impact onto the pins. A significant proportion of the contamination is already separated out during the impact of the flocks against the pin roller and during the subsequent acceleration into the opposite direction. The pin roller then guides the flocks over a grid, which surrounds a part of the periphery of the roller, accelerates them upwardly into a hood which surrounds the roller, and engages them anew. As the flocks are turned several times when being thrown upwardly they come into contact with the grid on all sides during the passage along the spiral track, whereby particles of contamination are separated out.

The airflow which generates the movement of the flocks is partly generated by a first suction fan 14 and partly by a second suction fan 32 which is arranged in the second portion of the pneumatic feed line 12 downstream of the coarse cleaning unit. The coarse cleaning unit 30, however, also has its own suction fan 34 which ensures the sucking away of the dust in the hood, i.e..the dust which is freed on throwing the flocks upwardly. This fan 34 admittedly sucks away about 20% of the transport air from the pneumatic suction line. However, it runs at a constant speed of rotation and exerts a constant effect on the pressure conditions in the conveying duct 12. Furthermore, this suction fan 34 should not be used to adjust the pressure conditions in the suction duct 12.

A further suction fan is provided for transporting away the waste material, i.e. for transporting away the contamination and flocks which fall through the grid. This further suction fan is operated intermittently and only runs when a certain quantity of waste material has been collected. This further suction fan draws the requisite transport air out of the environment and thus also has no significant effect on the pressure conditions of the conveying duct 12.

A fire separating unit 36 can optionally be inserted into the pneumatic conveying duct 12 after the suction fan 32. A fire separating unit of this kind comprises a spark sensor 38 and a rapid deployment flap 40 which rapidly opens when sparks are found by the spark sensor and guides the flocks together with the sparks through a branch line 42 into a collecting container 44.

The pneumatic conveying duct 12 then continues further into a mixer 46 which can, for example, be formed by a combined mixing and cleaning machine, such as the Unimix B7/3 of Maschinenfabrik Rieter AG. The optionally provided cleaning part of this machine is identified by 49. In this mixer the flocks are deposited in various vertical chambers and the transport air escapes out of the duct 12, schematically illustrated by the arrow 47. Downstream of the second suction fan 32, a leakage air supply orifice 48 is provided in the pneumatic conveying duct 12 and can be adjusted to control the pressure conditions at the input of the mixer 46.

Figure 2:
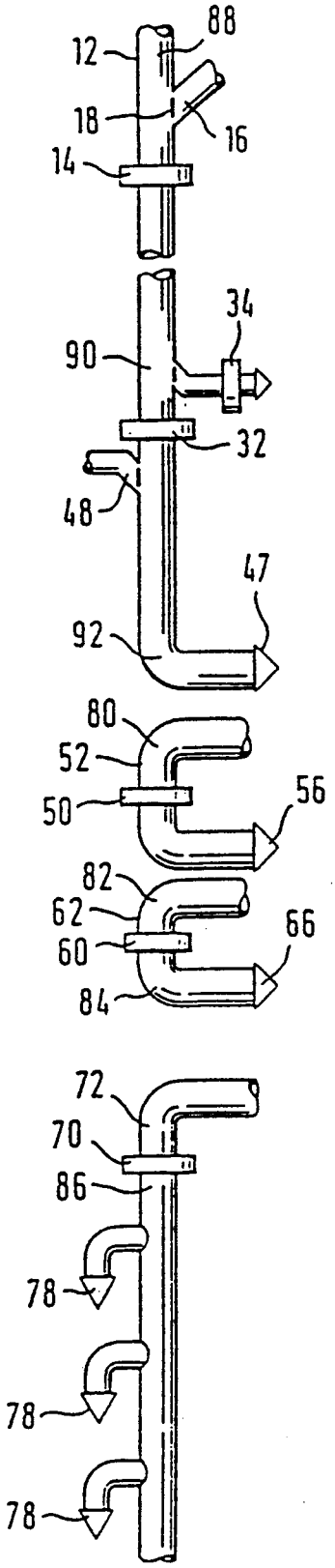
FIG. 2 illustrates a schematic representation of the air system of the process line of FIG. 1, whereby, however, for the sake of illustration, the units which are optionally provided, and which are surrounded in FIG. 1 with broken lines, are not shown in the air system diagram, FIG. 3, a graph relating the volume flow through a duct to the rate of production.

The duct 12 terminates at the position where the air escapes from the duct 12, into the vertical chambers of the mixer. In other words, the first section of the air system terminates here and is thus decoupled air-pressurewise from the next section A third suction fan 50 is located after the mixer 46 and guides the mixed flocks from the mixer 46 through a further pneumatic conveying duct 52 to a first fine cleaning machine 54. This fine cleaning machine 54, which can, for example be an ERM cleaner from Maschinenfabrik Rieter AG, is so constructed that the air which is sucked in anew through the third fan 50 is discharged again. This is illustrated in FIG. 2 by the arrow 56. This takes place in manner known per se in such a way that the fiber material is sucked in by the fan integrated into the suction head of the ERM cleaner from the machine which is inserted before the ERM cleaner, in this example from the mixer 46, and is blown into the laminar chute of the cleaner. The transport air compresses the flocks into a uniform fleece and it subsequently escapes between the lamina. At the lower end of the laminar chute the air passes into a sieve drum and is fed in a duct directly to the filter system as transport air containing dust. This is indicated by the arrow 56. In other words, an autonomously functioning section of the air system is present here. The pressure which prevails in this way in the critical region is determined by one adjustable unit, i.e., by the suction fan 50.

The mixture of flocks which is now well mixed and which has been finely cleaned once is transported out of the first fine cleaning machine 54 by means of a fourth suction fan 60 into a further fine cleaning machine 64. This can for example likewise be an ERM cleaner of Maschinenfabrik Rieter AG.

At the lower end of the laminar chute of the second fine cleaning machine 64 the air passes into a sieve drum and is fed in a tube duct direct to the filter system as transport air containing dust which is indicated with the arrow 66. This is also an autonomously functioning section of the air system, as the pressure value in the critical region 82 is solely determined by the adjustment of the speed of the suction fan 60.

The reference numeral 68 indicates that a further dust removing unit 68 can follow the ERM cleaner 64. The fiber fleece which is present at the output of the ERM cleaner, or, if provided at the output of the subsequent dust removing unit, is then sucked into a further pneumatic transport duct 72 by a further suction fan 70 and is supplied by means of this pneumatic conveying duct 72 to the filling shafts 74 of a row of carding machines 76.

The transport air escapes from the filling shafts of the carding machines, as is indicated by the arrows 78, and it is fed via a collecting duct to the filter system. An autonomously operating section of the air system is also present here since the speed of rotation of the suction fan 70 determines the pressures in the pneumatic transport duct 72.

The pneumatic pipe ducts 52, 62 and 72 thus each contain only one suction fan 50, 60 or 70, respectively, which can be adjusted in accordance with the prevailing method to a predeterminable speed of rotation, optionally in dependence on the respective production rate. It is admittedly necessary to observe critical pressures in these pneumatic ducts, for example at 80 at the input of the pneumatic conveying duct 52, i.e., at the output of the Unimix mixer 56, at 82 at the input of the pneumatic conveying duct 62, i.e., at the output of the first ERM cleaner, and at the output of the pneumatic conveying duct 82, i.e., after the second ERM fine cleaning unit. The pressure region 86 downstream of the suction fan 70 is also a critical pressure region. The pressure values in the critical pressure regions 80, 82, 84 and 86 can, however, be straightforwardly controlled or regulated by controlling the respectively associated suction fan 50, 60 or 70, respectively and this is readily possible through autonomously operating regulating circuits.

Further critical pressure regions are, however, the region 88 at the input of the pneumatic conveying duct 12, i.e..the pressure at the output of the bale opening machine, and the pressure in the region 90 at the input of the coarse cleaning machine 30. The pressures in these two critical regions are effected both by the adjustment of the first suction fan 14 and also by the adjustment of the second suction fan 32 as well as by the adjustment of the leakage air supply orifice 48. The pressure values are also dependent on whether the slider 18 is opened or closed, i.e., whether processed waste is being fed into the transport duct 12. A corresponding pressure sensor is present for each critical region and for the purpose of a simplified illustration in FIG. 1, is identified by the same reference numeral as a critical region itself.

For a specific production rate (kg/h), the designer determines a first reduced pressure range for the critical region 88. So long as the actually prevailing pressure lies in this range, the operator can assume that this part of the system is functioning in the correct manner. The pressure in the critical region 88 is determined primarily by the suction fan 14. It is, however, also influenced by the second suction fan 32 and by the adjustment of the leakage air supply orifice 48 and of the slider 18. The pressure in the second critical pressure region 90 is primarily determined by the adjustment of the second suction fan 32, but also by the adjustment of the leakage air supply orifice 48 and by the adjustment of the suction fan 14, and also by the slider 18. Variable units in the sense of the regulation of the pressure conditions are, however, in this example only the suction fans 14, 32 and the leakage air supply orifice 48. The setting of the slider 18 depends on the selected production method.

The corresponding desired value inputs for the suction fans 14, 32 and for the adjustment means for the leakage air supply orifice 48, are predetermined by a computer 94. The desired value inputs from the computer 94 are found in accordance with an iterative process. In the computer 94 there are stored respective pressure value ranges for the pressures prevailing in the critical regions 88 and 90 for each envisaged production quantity, (kg/h). It is assumed, by way of example, that, upon switching on the system, the pressure in the critical region 88 lies above the permissible limit, whereas the pressure in the critical region 90 lies below the permissible minimum limit.

The computer now aims at a reduction of the pressure value in the critical region 88 through a correction (increase) of the desired value for the speed of rotation of the first suction fan 14. After the correction of this desired value the actual value changes accordingly and the pressure in the critical region 88 decreases, however not so far that the pressure value lies within the desired range which is provided. The increase of the speed of rotation of the suction fan 14 through the correction of its desired value leads however additionally to an increase of the pressure value in the critical region 90, however this increase is not sufficient in order to raise the pressure value at 90 over the minimum limits.

This now requires a lowering of the speed of rotation of the second suction fan 32, which is calculated by the computer and is executed in the form of a new desired value input for the speed of rotation of the suction fan 32. Through the reduction of the speed of rotation of the second suction fan 32, the pressure value in the critical region 90 increases. The pressure, value in the critical region 88, however, increases again because the first suction fan 14 must now operate against a higher resistance. It is assumed that the pressure value does not rise beyond the starting value. This first stage of the regulation has thus led to the pressure in the critical region 88 coming closer to the desired range and thus also applies to the pressure in the second critical region 90. Starting from the relative size of the changes that have occurred the computer now calculates a further change of the desired value input for the first suction fan 14 with the object of further lowering the pressure in the critical region 88. On taking account of the new desired value, the pressure in the critical region 90 then increases again, however still not so far that the pressure value at 90 lies above the minimum limit, so that a further reduction of the speed of rotation of the second fan 32 is necessary which, however, also leads to an increase of the pressure value at 88. This routine is repeated until the pressure values in the two critical regions 88 and 90 both lie within the respectively provided desired ranges.

Naturally, the above described method only represents one example as to how the regulating process can take place in detail. The precise course of the regulating process depends on the respectively measured pressure conditions. The computer is, however, so programmed that it effects an iterative regulation depending on the starting pattern, i.e., the size of the pressure deviation and the direction of the pressure deviations with the iterative regulation leading to the pressures lying at the end of the iterative procedure in the respective desired ranges. Since the pressure values change for each regulation step, a new pattern arises which is recognized by the computer and which forms the basis for the determination of the further changes of the desired value inputs. With a change of production, or for example with a change resulting from opening of the slider 18, new conditions arise which lead to new pressures and, thus, to a new adjustment of the adjustable units.

It will be understood that with different pressure patterns different measures can be taken. If, for example, the pressure at the output end of the pneumatic conveying duct 12, i.e., in a further critical region 92, is too low, then this pressure can be influenced by the opening of the leakage air supply orifice 48 without a pronounced change of the pressure occurring in the critical pressure range 88.

The pressure sensors provided in the critical regions can be continuously monitored by the regulation means in order to check that the pressure values which are provided are maintained. In the case of an undesired change of the pressure values during constant production, one knows that a blockage is developing or that other sources of faults are occurring. Thus, the computer can initiate an alarm or interrupt the production.

The system can also be formed as a self-learning system, i.e., the computer notes the selected desired value inputs for the adjustable units for different production rates and uses these desired values, for the basic adjustments of the adjustable units for the next time a changeover is made to the corresponding production rate. This regulation of the adjustable units to the desired values which are provided can be effected by the regulation circuits associated with the adjustable units or by the computer itself, in so far as the computer is also programmed for carrying out such regulation processes.

If the optionally provided cleaning units 49 and 64 are present, then critical pressure regions 96 and 98 are also present here. The pressure values at these regions are, however, uniquely determined by the adjustment of the respective suction fan 50 or 60, so that these cleaning units belong in this embodiment to autonomously functioning regions which can be regulated with a customary regulation circuit.

The regulating steps should be effected so that short term fluctuations which occur of the measured pressure values are ignored. The sense of this measure is to take account only of persistent changes of pressure. The subject of the application, is namely not directed to a regulation which endeavors to so regulate the course of a process that predetermined pressure values are continuously regulated to the respectively provided value, but rather to the setting of the pressure values within the respectively predetermined pressure ranges and, after this adjustment has been made, no adjustment should be made again unless a new adjustment is to be effected as a result of a change in production or a change of material.

If one were to take account of such short term pressure fluctuations, which can, for example, arise due to irregularity in the flow of flocks, then the danger exists that such fluctuations would lead to faulty indications or faulty settings. Thus, it is more reasonable to filter out or ignore such pressure changes through the regulating algorithm that is used.

Figure 3:
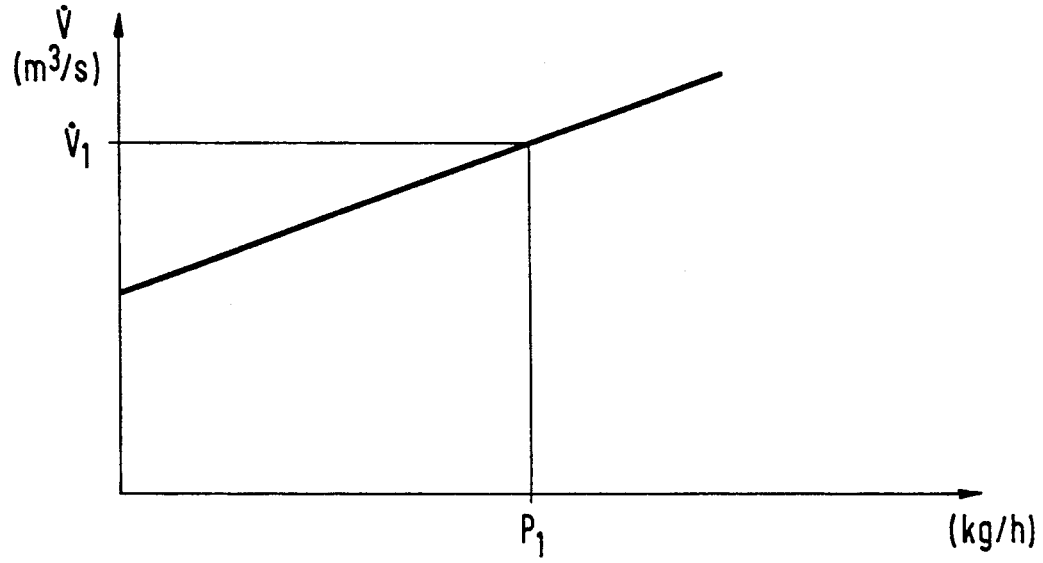
Figure 4:
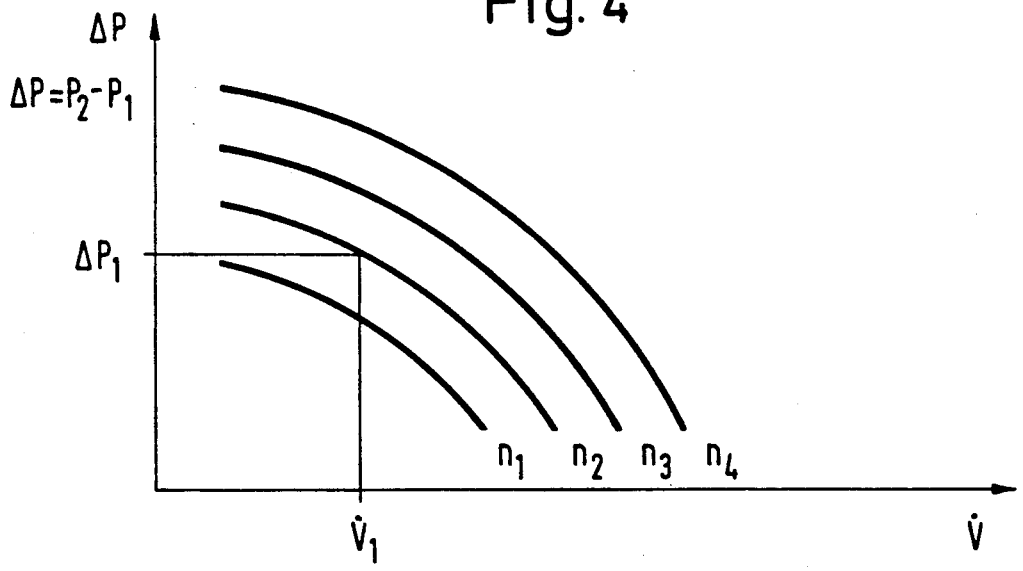
FIG. 4 illustrates pressure/volume flow characteristics of a suction fan for different speeds of the fan.

The method described above is based on the concept that desired pressure ranges are known for each critical pressure region. In practice it is frequently more convenient to operate conceptually in terms of volume flow. FIG. 3 shows a graph which relates the volume flow through a duct (in $m^3$/sec) to the production rate (in kg/hour). This graph basically applies to all duct elements of the system and thus also to the ducts of suction fans and the like. It can be assumed that for a given production rate $P_1$ there will be an appropriate volume flow $V_1$. The graph of FIG. 4 shows the pressure increase/volume flow characteristic for a suction fan for different speeds of rotation. The pressure increase across a suction fan is easily measured by means of two pressure sensors, a first sensor positioned immediately upstream of the fan and a second sensor positioned immediately downstream of the fan. The first sensor measures $P_1$ and the second sensor $P_2$. The pressure increase across the suction fan is thus $P_2-P_1=\Delta_p$. To achieve the desired volume flow $V_1$ a pressure $\Delta_{P1}$ should thus be measured when the speed of the fan is $n_2$. In practice, the pressure increase $\Delta_P$ is measured and the existing volume flow V can be calculated from the graph of FIG. 4 on the basis of the prevailing speed of rotation of the fan, say $n_1$. The speed of rotation n is of course known to the computer which instructs the desired speed setting of the suction fan. The graph of FIG. 4 is stored in the computer 94 in the form of look-up tables, for example. If the measured volume flow V is too small, then the computer can select a higher speed of rotation in an attempt to increase V. The new speed of rotation will result in a higher pressure difference $\Delta_P$ and the computer can check whether the new $\Delta_P$ at the new speed of rotation n corresponds to the desired volume flow and can make further corrections as necessary. This is again an iterative process, since the $\Delta_P$ which results from changing the speed of rotation n depends on the conditions prevailing elsewhere in the duct and on the settings of the other units. However, the relationships between $\Delta_P$, n and V are particularly clear so that it is relatively straightforward to program the computer to carry out the iterative procedure in such a way that it rapidly reliably converge.

Furthermore, it will be appreciated that similar characteristics can be established for other adjustable units, such as induction or suction boxes or leakage air orifices, and these characteristics can also be stored in the computer for use in optimizing the operating pressures (volume flows) in the transport system. In each case it is only necessary to measure the pressure difference upstream and downstream of the relevant unit and to relate this pressure difference to different volume flows for a range of different settings of the unit. For an induction box, this setting is again the speed of rotation of the fan. For leakage air orifices, it could be the angle of opening of the relevant flap or the size of the leakage orifice.

Figure 5:
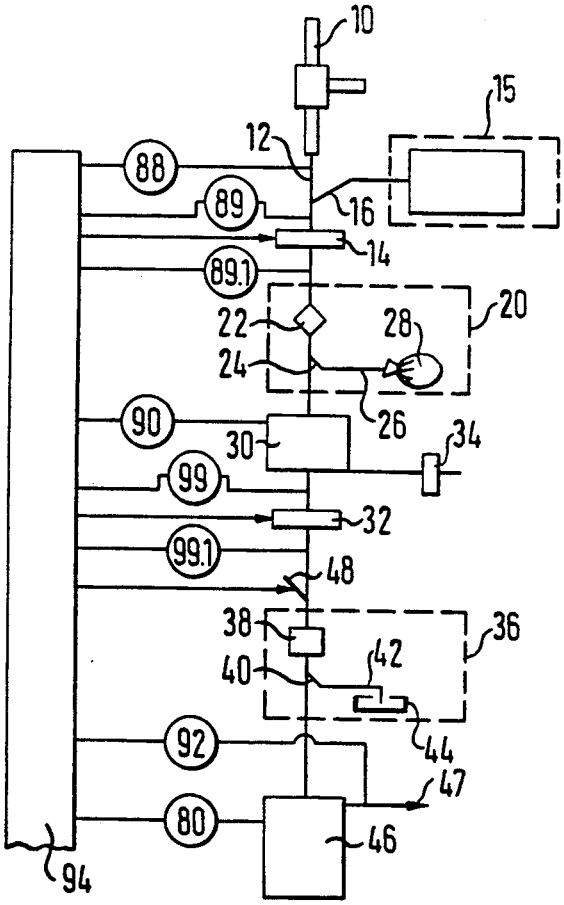
FIGS. 5 and 6 illustrate a modified form of the invention similar to the representation of FIGS. 1 and 2, but adapted to make use of the characteristics of FIG. 4 in setting the required air flow conditions in the duct.
Figure 6:
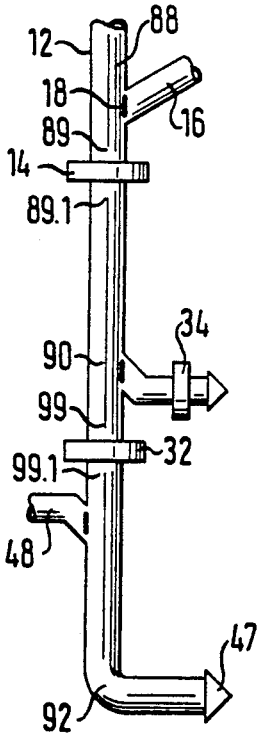

FIGS. 5 and 6 show an example similar to the first part of FIGS. 1 and 2, showing the use of pressure difference measurements at the first and second suction fans 14 and 32. For the sake of convenience the FIGS. 5 and 6 use the same reference numerals as FIGS. 1 and 2 to designate items common to both embodiments. These common items do not therefore need to be separately described. In addition to these common items, FIGS. 5 and 6 show the use of two pressure sensors 89 and 89.1 disposed respectively upstream and downstream of the fan 14 and two further pressure sensors 99 and 99.1, which are correspondingly disposed relative to the second suction fan 32. Reference is made by the computer 94 to the measured pressure values at pressure sensors 89, 89.1 and 99, 99.1 from which the prevailing pressure differences are calculated to permit iterative adjustment of the volume flows with reference to the characteristics of FIG. 4. If the volume flows are correct, then the pressures in the critical regions 88, 90 and 92 should also be correct and the pressure sensors which are optionally provided there (in this embodiment) can be used to check the result of the iterative adjustments at the two suction fans. If this is not done, then particular care must be taken to ensure that the amount of air entering the duct 12 via the branch line 16 is not excessive, since otherwise the pressure in the duct in the region 88 might well be too low. The amount of air flowing through the branch line 16 can be determined via appropriate pressure regions, e.g. with reference to the volume flow supplied by a further fan (not shown) responsible for feeding waste motions along the line 16, or with reference to the pressure drop across the orifice where the branch line joins the duct 12. It is of course clear that a change of setting of one of the fans will also result in a change at the other fan. However, the directions and magnitudes of the changes of the speed of rotation which must be instructed at the two fans can be readily predicted from the stored pressure/volume flow characteristics for the two fans.

The same pressure difference measurement technique can also be used for setting the speeds of rotation of the fans of the autonomously operating units so as to achieve the desired volume flow therethrough.

What is claimed is:

1. A method of operating a pneumatic transport system in a process line of a spinning mill, the pneumatic transport system extending from a bale opening machine via at least one additional machine to a carding system, wherein fiber flocks are transported through ducts by means of airflows generated by fans, the airflows being adapted to be affected by units, the units comprising fans, adjustable flaps, leakage air openings, and induction boxes, said method comprising the steps of:

(a) measuring, in each of a plurality of critical regions, the respectively prevailing static pressure by means of pressure sensors;

(b) determining whether at least one of said respectively prevailing static pressures is outside of a predetermined desired range;

(c) adjusting at least one of said units in a manner to affect said at least one of said respectively prevailing static pressures to change same in a direction toward or into said desired range, if said at least one of said respectively prevailing static pressures is outside of said predetermined desired range;

(d) determining the magnitude of a change in a prevailing static pressure in at least one further critical region affected by said step of adjusting;

(e) adjusting a further one of said units in a manner to affect said prevailing static pressure in said at least one further critical region to change same toward or into a predetermined desired range for said at least one further critical region, if said prevailing static pressure of said at least one further critical region is outside of said predetermined desired range for said at least one further critical region; and (f) repeating steps (a) through (e), as necessary, until measured pressures lie in said desired ranges.

2. The method in accordance with claim 1, wherein: short term pressure fluctuations which occur are ignored during said steps of determining.

3. The method in accordance with claim 1, further comprising the step of:

terminating said method after said critical regions lie within respective desired ranges.

4. The method in accordance with claim 3, further comprising the steps of:

measuring the pressures prevailing in the critical regions at intervals of time and, if any of said prevailing pressures are outside respective desired ranges, performing again said steps of adjusting until prevailing pressures at said critical regions lie within respective desired ranges.

5. The method in accordance with claim 4, wherein: said steps of measuring are performed in time intervals in the region from once per day to one per several months.

6. The method in accordance with claim 5, wherein: said time intervals are in the region of one per week.

7. The method in accordance with claim 1, wherein: steps (a) through (f) are performed after a step in production of the spinning mill.

8. The method in accordance with claim 1, wherein: steps (a) through (f) are performed after a change in material composition of material transported through the pneumatic transport system.

9. The method in accordance with claim 1, further comprising the step of:

determining an intended rate of production and setting said desired ranges as a function of said intended rate of production.

10. The method in accordance with claim 1, further comprising the step of:

changing a production rate and adjusting prevailing pressures in said critical regions in accordance with said steps of adjusting.

11. The method in accordance with claim 1, said system further comprising autonomously functioning regions of said pneumatic transport system, whereby a plurality of units determine the pressure in the respective critical regions, wherein said method further comprises:

performing steps (a) through (f) in said autonomously functioning regions.

12. The method in accordance with claim 1, said system further comprising:

autonomously functioning regions of said pneumatic transport system in which only one unit, respectively, is responsible for the pressure prevailing at a respective critical region, wherein said steps are separately performed for said one unit.

13. The method in accordance with claim 1, whereby: for each of said critical regions, a step of adjusting is first performed for a unit which affects the prevailing pressure to the greatest degree.

14. The method in accordance with claim 13, wherein:

said steps of adjusting are performed in a sequence corresponding to an order of critical regions with regard to the direction of flow, beginning at a critical region at which a step of adjusting is first required, as defined in steps (c) and (e).

15. The method in accordance with claim 1, wherein: said steps of adjusting include adjusting said units in successively smaller amounts to achieve a converging iterative adjustment of the prevailing pressures into the respective desired ranges.

16. The method in accordance with claim 1, wherein said bale opening machine feeds fiber flocks into a duct of said pneumatic transport system, wherein said fans include a first suction fan provided in said duct, a coarse cleaning unit, a second suction fan, a means for feeding processed waste into said duct between the bale opening machine and said first suction fan, wherein:

(i) said step of measuring is performed (1) in a first critical region at an outlet of said bale opening machine upstream of said first suction fan and upstream of said means for feeding processed waste and (2) in a second critical region upstream of said second suction fan;

(ii) said step of adjusting at least one of said units comprises adjusting a displacement rate of said first suction fan for adjusting the prevailing pressure in said first critical region;

(iii) said step of adjusting a further one of said units comprises performing at least one step selected from the group consisting of (1) changing a degree of opening of a leakage air orifice which opens into said duct, and (2) adjusting a displacement rate of said second suction fan for adjusting the prevailing pressure in said second critical region;

said steps (ii) and (iii) are performed repeatedly until measured pressures lie within said desired ranges.

17. The method in accordance with claim 1, further comprising the steps of:

continuously measuring said prevailing pressures;

performing at least one step selected from the group consisting of (1) providing a warning signal and (2) discontinuing fiber flock transport upon measurement of a prevailing pressure at an impermissible deviation from a selected pressure.

18. The method in accordance with claim 1, further comprising the steps of:

measuring said prevailing pressures at regularly repeating intervals;

performing at least one step selected from the group consisting of (1) providing a warning signal and (2) discontinuing fiber flock transport upon measurement of a prevailing pressure at an impermissible deviation from a selected pressure.

19. The method in accordance with claim 1, wherein: at least one of said fans is built into treatment devices of said fiber flocks and does not significantly affect said prevailing pressure.

20. The method in accordance with claim 1, further comprising the steps of:

measuring a pressure differential across at least one of said fans and determining the value of a variable parameter of said at least one of said fans;

determining a prevailing volume flow through said at least one of said fans with reference to a performance characteristic of said at least one of said fans, relating pressure differential to volume flow for various settings of said variable parameter; and iteratively varying said variable parameter of said at least one of said fans until a pressure difference is measured which corresponds at a prevailing setting of the variable parameter of said at least one of said fans to a desired volume flow through said at least one of said fans.

* * * * *